US007897060B2

(12) United States Patent
Böse et al.

(10) Patent No.: US 7,897,060 B2
(45) Date of Patent: Mar. 1, 2011

(54) MAGNETORHEOLOGICAL MATERIALS HAVING A HIGH SWITCHING FACTOR AND USE THEREOF

(75) Inventors: Holger Böse, Würzburg (DE); Alexandra-Maria Trendler, Würzburg (DE)

(73) Assignee: Fraunhofer-Gesselschaft zur Forderung der Angewandten Forschung e.V., Munich (DE)

( * ) Notice: Subject to any disclaimer, the term of this patent is extended or adjusted under 35 U.S.C. 154(b) by 169 days.

(21) Appl. No.: 11/574,395

(22) PCT Filed: Aug. 25, 2005

(86) PCT No.: PCT/EP2005/009193

§ 371 (c)(1),
(2), (4) Date: Feb. 27, 2007

(87) PCT Pub. No.: WO2006/024455

PCT Pub. Date: Mar. 9, 2006

(65) Prior Publication Data

US 2007/0252104 A1 Nov. 1, 2007

(30) Foreign Application Priority Data

Aug. 27, 2004 (DE) ..... 10 2004 041 650

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | | |
|---|---|---|---|---|
| 2,575,360 | A | 11/1951 | Rabinow | |
| 2,938,183 | A * | 5/1960 | Dillon, Jr. | 336/218 |
| 3,425,666 | A * | 2/1969 | Lindquist et al. | 252/62.58 |
| 3,855,691 | A * | 12/1974 | Deschamps et al. | 29/608 |
| 5,019,537 | A | 5/1991 | Kato et al. | |
| 5,158,109 | A | 10/1992 | Hare, Sr. | |
| 5,161,653 | A | 11/1992 | Hare, Sr. | |
| 5,525,249 | A * | 6/1996 | Kordonsky et al. | 252/62.56 |
| 5,549,837 | A | 8/1996 | Ginder et al. | |
| 5,578,238 | A * | 11/1996 | Weiss et al. | 252/62.52 |
| 5,645,752 | A * | 7/1997 | Weiss et al. | 252/62.54 |
| 5,667,715 | A | 9/1997 | Foister | |
| 5,771,013 | A | 6/1998 | Fey | |
| 5,878,997 | A | 3/1999 | Miesner | |
| 5,900,184 | A | 5/1999 | Weiss et al. | |
| 5,905,112 | A | 5/1999 | Hellermann | |
| 5,971,835 | A | 10/1999 | Kordonski et al. | |
| 5,985,168 | A * | 11/1999 | Phule | 252/62.52 |
| 6,027,664 | A | 2/2000 | Weiss et al. | |
| 6,095,295 | A | 8/2000 | Park et al. | |
| 6,123,633 | A | 9/2000 | Guenther et al. | |
| 6,203,717 | B1 | 3/2001 | Munoz et al. | |
| 6,279,702 | B1 | 8/2001 | Koh | |
| 6,314,612 | B1 | 11/2001 | Rennecke et al. | |
| 6,395,193 | B1 * | 5/2002 | Kintz et al. | 252/62.52 |
| 6,399,193 | B1 | 6/2002 | Ellison | |
| 6,439,356 | B1 | 8/2002 | Butera et al. | |
| 6,451,219 | B1 | 9/2002 | Iyengar et al. | |
| 6,592,772 | B2 | 7/2003 | Foister et al. | |
| 6,599,439 | B2 | 7/2003 | Iyengar et al. | |
| 6,610,404 | B2 | 8/2003 | Starkovich et al. | |
| 7,354,528 | B2 * | 4/2008 | Cheng et al. | 252/62.52 |
| 7,393,463 | B2 * | 7/2008 | Ulicny et al. | 252/62.52 |
| 7,419,616 | B2 * | 9/2008 | Ulicny et al. | 252/62.52 |
| 7,521,002 | B2 * | 4/2009 | Cheng et al. | 252/62.52 |
| 2002/0066881 | A1 | 6/2002 | Koppe | |
| 2003/0035955 | A1 | 2/2003 | Yadav | |
| 2004/0105980 | A1 | 6/2004 | Sudarshan et al. | |
| 2004/0126565 | A1 | 7/2004 | Naganathan et al. | |
| 2005/0116194 | A1 | 6/2005 | Fuchs et al. | |
| 2005/0258009 | A1 | 11/2005 | Reinhardt et al. | |
| 2007/0210274 | A1 | 9/2007 | Böse | |
| 2008/0318045 | A1 | 12/2008 | Böse | |
| 2010/0162776 | A1 | 7/2010 | Böse et al. | |
| 2010/0193304 | A1 | 8/2010 | Böse et al. | |

FOREIGN PATENT DOCUMENTS

| | | | |
|---|---|---|---|
| CA | 2059356 | | 7/1992 |
| DE | 40 30 780 | A1 | 4/1991 |
| DE | 41 01 869 | A1 | 7/1992 |
| DE | 38 90 400 | C2 | 2/1994 |
| DE | 693 01 084 | T2 | 5/1996 |
| DE | 196 14 140 | C1 | 5/1997 |
| DE | 196 13 194 | A1 | 10/1997 |
| DE | 197 25 971 | A1 | 12/1998 |
| DE | 198 01 752 | C1 | 5/1999 |
| DE | 199 10 782 | A1 | 9/2000 |
| DE | 100 24 439 | A1 | 12/2001 |
| DE | 102004007621 | A1 | 9/2005 |
| DE | 202004008024 | U1 | 11/2005 |
| DE | 600 18 956 | T2 | 3/2006 |
| DE | 102004041650 | A1 | 3/2006 |

(Continued)

OTHER PUBLICATIONS

English translation of International Preliminary Report on Patentability from International Patent Application No. PCT/EP2005/009193.

(Continued)

*Primary Examiner* — C. Melissa Koslow
(74) *Attorney, Agent, or Firm* — Leydig, Voit & Mayer, Ltd.

(57) ABSTRACT

The invention relates to magnetorheological materials comprising at least one non-magnetisable carrier medium and magnetisable particles contained therein, at least two magnetisable particles fractions being contained as particles and these being formed from non-spherical particles and from spherical particles.

23 Claims, 3 Drawing Sheets

FOREIGN PATENT DOCUMENTS

| | | | |
|---|---|---|---|
| DE | 102004043281 | A1 | 3/2006 |
| EP | 0 418 807 | B1 | 2/1995 |
| EP | 0 784 163 | A1 | 7/1997 |
| EP | 1 070 872 | A1 | 1/2001 |
| EP | 1219857 | A1 | 7/2002 |
| EP | 1 247 664 | A2 | 10/2002 |
| EP | 1 283 530 | A2 | 2/2003 |
| EP | 1 283 531 | A2 | 2/2003 |
| EP | 1 372 162 | A1 | 12/2003 |
| GB | 2267947 | A | 12/1993 |
| WO | WO 93/21644 | A1 | 10/1993 |
| WO | WO 94/10693 | A1 | 5/1994 |
| WO | WO 94/10694 | A1 | 5/1994 |
| WO | WO 01/61713 | A1 | 8/2001 |
| WO | WO 01/84568 | A2 | 11/2001 |
| WO | WO 02/45102 | A1 | 6/2002 |
| WO | WO 03/021611 | A1 | 3/2003 |
| WO | WO 03/025056 | A1 | 3/2003 |
| WO | WO 2006/024456 | A2 | 3/2006 |
| WO | WO 2006/024457 | A1 | 3/2006 |
| WO | WO 2007/012410 | A1 | 2/2007 |
| WO | WO 2008/125305 | A1 | 10/2008 |
| WO | WO 2008/125306 | A1 | 10/2008 |

OTHER PUBLICATIONS

"Proceedings of the 5th International Conference on Electro-Rheological Fluids, Magneto-Rheological Suspensions and Associated Technology", Sheffield, UK, Jun. 1995, Bullough, W.R. Ed., World Scientific Publishing Co. Pte. Ltd., Singapore (1995) pp. vii-xiii.

Chin et al., "Rheological Properties and Dispersion Stability of Magnetorheological (MR) Suspensions", Rheol Acta, 40: pp. 211-219 (2001).

Davis, L.C., "Model of Magnetorheological Elastomers", Journal of Applied Physics, 85(6): pp. 3348-3351 (1999).

Ginder et al., "Magnetorheological Elastomers: Properties and Applications", SPIE, 3675: pp. 131-138 (1999).

Jolly et al., "The Magnetoviscoelastic Response of Elastomer Composites Consisting of Ferrous Particles Embeddded in a Polymer Matrix", Journal of Intelligent Material Systems and Structures, vol. 7, pp. 613-622 (Nov. 1996).

Jolly et al., "A Model of the Behaviour of Magnetorheological Materials", Smart Mater. Struct., 5: pp. 607-614 (1996).

Jolly et al., "Properties and Applications of Commercial Magnetorheological Fluids", SPIE, vol. 3327, pp. 262-275 (1998).

Shen et al., "Experimental Research and Modeling of Magnetorheological Elastomers", Journal of Intelligent Material Systems and Structures, vol. 15, pp. 27-35 (Jan. 2004).

Florian, Zschunke, "Aktoren auf Basis des magnetorheologisten Effekts" [online], Jun. 20, 2005, p. 21, line 1-26, line 5.

* cited by examiner

MAGNETORHEOLOGICAL MATERIALS HAVING A HIGH SWITCHING FACTOR AND USE THEREOF

This application is the U.S. National Phase of International Patent Application PCT/EP2005/009193, filed on Aug. 25, 2005, which claims priority to German Patent Application No. 10 2004 041 650.8, filed Aug. 27, 2004, all of which are hereby incorporated by reference.

The present invention relates to magnetorheological materials having a high switching factor, in particular to magnetorheological fluids (MRFs) having a high switching factor, and use thereof.

MRFs are materials which change their flow behaviour under the effect of an external magnetic field. Like their electrorheological analogues, the so-called electrorheological fluids (ERFs), they generally concern non-colloidal suspensions made of particles which can be polarised in a magnetic or electrical field in a carrier fluid which possibly contains further additives.

The fundamental principles of MRFs and first devices for using the magnetorheological effect are attributable to Jacob Rabinow in 1948 (Rabinow, J., Magnetic Fluid Clutch, National Bureau of Standards Technical News Bulletin 33(4), 54-60, 1948; U.S. Pat. No. 2,575,360). After an initially great stir, the interest in MRFs firstly ebbed and then experienced a renaissance from the middle of the nineties (Bullough, W. A. (Editor), Proceedings of the 5th International Conference on Electro-Rheological Fluids, Magneto-Rheological Suspensions and Associated Technology (1.), Singapore, New Jersey, London, Hong Kong: World Scientific Publishing, 1996). In the meantime, numerous magnetorheological fluids and systems are commercially available, such as e.g. MRF brakes and also various vibration and shock absorbers (Mark R. Jolly, Jonathan W. Bender and J. David Carlson, Properties and Applications of Commercial Magnetorheological Fluids, SPIE 5th Annual Int. Symposium on Smart Structures and Materials, San Diego, Calif., Mar. 15, 1998). In the following, a few special properties of MRFs and their ability to be influenced are described.

MRFs are generally non-colloidal suspensions of magnetisable particles of approx. 1 micrometer up to 1 millimeter in size in a carrier fluid. In order to stabilise the particles relative to sedimentation and to improve the application properties, the MRF can contain in addition additives, such as e.g. dispersion agents and supplements which have a thickening effect. Without an external magnetic field, the particles are distributed ideally homogeneously and isotropically so that the MRF has a low dynamic basic viscosity $\eta_o$ [measured in Pa·s] in the non-magnetic space. When applying an external magnetic field H, the magnetisable particles arrange themselves in chain-like structures parallel to the magnetic field lines. As a result, the flow capacity of the suspension is restricted, which makes itself noticeable macroscopically as an increase in viscosity. The field-dependent dynamic viscosity $\eta_H$ thereby increases as a rule monotically with the applied magnetic field strength H.

In practice, the dynamic viscosity of an MRF is determined with a rotational viscosimeter. For this purpose, the shear stress $\tau$ [measured in Pa] is measured at different magnetic field strengths and prescribed shear rate D [in $s^{-1}$]. The dynamic viscosity $\eta$ is thereby defined [in Pa·s] by $$\eta=\tau/D \tag{1}$$

The changes in the flow behaviour of the MRFs depend upon the concentration and type of the magnetisable particles, upon their shape, size and size distribution; however also upon the properties of the carrier fluid, the additional additives, the applied field, temperature and other factors. The mutual interrelationships of all these parameters are exceptionally complex so that individual improvements in an MRF with respect to a special target size have been the subject of tests and optimisation efforts time and time again.

A research priority thereby was the development of MRFs with a high switching factor. In equation (2), the switching factor $W_D$ is defined at a fixed shear rate D as the ratio of the shear stress $\tau_H$ of the MRFs in the external magnetic field H to the shear stress $\tau_O$ without a magnetic field:

$$W_D=\tau_H/\tau_O \tag{2}$$

The external magnetic field strength H [measured in A/m] is correlated according to equation (3) with the magnetic flux density B [measured in N/A·m=T]

$$B=\mu_r\cdot\mu_o\cdot H \tag{3}$$

with $\mu_r$: relative permeability of the medium, the magnetic flux density of which is intended to be determined, $\mu_o=4\cdot\pi\cdot10^{-7}$V·s/A·m: absolute permeability.

Since it has in practice proved to be useful to indicate magnetic coefficients as a function of the magnetic flux density B, the switching factor is subsequently transformed to this reference system $$W_D=\tau_B/\tau_O \tag{4}$$

with $\tau_B$: shear stress of the MRF in the external magnetic field H with the magnetic flux density B.

The switching factor $w_D$ can hence be regarded as a value of the convertibility of a magnetic excitation into a rheological state change of the MRF. A "high" switching factor means that, with a low magnetic flux density change B, a large change in the shear stress $\tau_B/\tau_O$ or the dynamic viscosity $\eta_B/\eta_O$ in the MRF is achieved. In the past, there were numerous attempts to optimise the switching factor by suitable choice of the magnetisable particles with respect to higher effectiveness of the MRF.

As a rule, spherical particles comprising carbonyl iron are used for MRFs. However, MRFs are known also with other magnetisable materials and material mixtures. Thus WO 02/45102 A1 describes an MRF with a mixture of high purity iron particles and ferrite particles in order simultaneously to optimise the properties of the MRF with and without a magnetic field. No details are given about the particle shape and size. Furthermore there are numerous patents relating to special particle geometries and distributions.

MRFs are known from U.S. Pat. No. 5,667,715, which contain spherical particles with a bimodal particle size distribution, the ratio of the average particle sizes of both fractions being between 5 and 10. In addition, the width of the particle size distributions of both individual fractions should not exceed the value of two thirds of the respective average particle sizes. In U.S. Pat. No. 5,900,184 and U.S. Pat. No. 6,027,664, MRFs with bimodal particle size distributions are likewise described, the ratio of the average particle sizes of both fractions being between 3 and 15. In EP 1 283 530 A2, the concentration of magnetisable particles, which are in turn present in bimodal size distribution, is indicated with 86-90% by mass.

U.S. Pat. No. 6,610,404 B2 describes a magnetorheological material comprising magnetic particles with defined geometric features, such as e.g. cylindrical or prismatic shapes inter alia. The production of particles of this type is very complex. In the case of highly asymmetric particles, a high basic viscosity of the MRF must in addition be taken into account. In U.S. Pat. No. 6,395,193 B1 and WO 01/84568 A2, magnetorheological compositions with non-spherical magnetic particles are described but these are not combined with spherical magnetic particles.

It is common to all the mentioned MRFs that they rely upon special particle sizes or particle size distributions and/or defined particle geometries in order to achieve a high switching factor. As a result, their preparation is complex and correspondingly expensive.

Starting herefrom, it is the object of the present invention to propose magnetorheological materials with a high switching factor, in particular MRFs with a high switching factor, the preparation of which is less complex and hence cost-effective.

This object is achieved by magnetorheological materials comprising at least one non-magnetisable carrier medium and magnetisable particles contained therein, characterised in that at least two magnetisable particle fractions p and q are contained as particles, p being formed from non-spherical particles and q from spherical particles. Advantageous developments of magnetorheological materials, in particular MRFs, which are produced in this way are described herein. Furthermore, options for use of the magnetorheological materials produced in this way are described herein.

According to the invention, magnetorheological materials, in particular MRFs, with two types of magnetisable particles are proposed, the first particle fraction p comprising irregularly shaped non-spherical particles and the second fraction q comprising spherical particles. By combining irregularly shaped non-spherical particles and spherical particles in the carrier medium, surprisingly both a low basic viscosity without field and a high shear stress in the external magnetic field are achieved. This means that the magnetorheological materials according to the invention have an exceptionally high switching factor. In addition, the production of the irregularly shaped particle fraction p is less complex and hence exceptionally cost-effective. Preferably, the average particle size of the fraction p is the same or greater than that of the fraction q. By using irregularly shaped, non-spherical particles, a significant cost advantage is therefore produced in comparison to the production of known materials.

It has emerged that, e.g. in the case of an MRF which contains by comparison only small spherical particles, the basic viscosity is significantly increased. In contrast, in the case of a different MRF which only contains the large irregularly shaped particles, significantly lower shear stresses in the magnetic field are determined. The MRF with a combination of large irregularly shaped, non-spherical particles and small spherical particles hence has a significantly improved property profile.

An advantageous embodiment of the magnetorheological materials according to the invention provides that the average particle size of the fraction p preferably has at least twice the value of the average particle size of the fraction q. Furthermore, it is favourable if the average particle sizes of the fractions p and q are between 0.01 μm and 1000 μm, preferably between 0.1 μm and 100 μm.

A further advantageous embodiment of the magnetorheological materials according to the invention provides that the volume ratio of the fractions p and q is between 1:99 and 99:1, preferably between 10:90 and 90:10.

Advantageously, the magnetisable particles can be formed from soft magnetic particles according to the state of the art. This means that the magnetisable particles can be selected both from the quantity of soft magnetic metallic materials, such as iron, cobalt, nickel (also in non-pure form) and alloys thereof, such as iron-cobalt, iron-nickel; magnetic steel; iron-silicon and from the quantity of soft magnetic oxide-ceramic materials, such as cubic ferrites of the general formula $$MO.Fe_2O_3$$

with one or more metals from the group M=Mn, Fe, Co, Ni, Cu, Zn, Ti, Cd or Mg; perovskites of the general formula $$M^{3+}B^{3+}O_3$$

where M is a trivalent rare earth element and B is Fe or Mn, or $$A^{2+}Mn^{4+}O_3,$$

where A is Ca, Sr, Pb, Cd, or Ba; and garnets of the general formula $$M_3B_5O_{12}$$

where M is a rare earth element and B is iron or iron doped with Al, Ga, Sc, or Cr.

In addition however also mixed ferrites, such as MnZn—, NiZn—, NiCo—, NiCuCo—, NiMg— or CuMg-ferrites can be used.

The magnetisable particles can however also comprise iron carbide or iron nitride particles and also alloys of vanadium, tungsten, copper and manganese and mixtures of the mentioned particle materials or mixtures of different magnetisable types of solids. The soft magnetic materials can thereby also be present in total or in part in impure form.

There should be regarded as carrier medium in the sense of the invention, carrier fluids and also fats, gels or elastomers. There can be used as carrier fluids the fluids known from the state of the art, such as water, mineral oils, synthetic oils such as polyalphaolefins, hydrocarbons, silicone oils, esters, polyethers, fluorinated polyethers, polyglycols, fluorinated hydrocarbons, halogenated hydrocarbons, fluorinated silicones, organically modified silicones and also copolymers therof or mixtures of these fluids.

The magnetorheological material of the invention optionally further contains additives selected from dispersion agents, antioxidants, defoamers and anti-abrasion agents.

In an advantageous embodiment of the magnetorheological materials according to the invention, inorganic particles, such as $SiO_2$, $TiO_2$, iron oxides, laminar silicates or organic additives and also combinations thereof can be added to the suspension in order to reduce sedimentation.

A further advantageous embodiment of the magnetorheological materials according to the invention provides that the inorganic particles are at least in part organically modified.

Further special embodiments of the magnetorheological materials provide that the suspension contains particulate additives, such as graphite, perfluoroethylene or molybdenum compounds, such as molybdenum disulphite and also combinations thereof in order to reduce abrasion phenomena. It is also possible that the suspension contains special abrasively acting and/or chemically etching supplements, such as e.g. corundum, cerium oxides, silicon carbide or diamond for use in the surface treatment of workpieces.

It has proved overall to be advantageous if the proportion of the magnetisable particles is between 10 and 70% by volume, preferably between 20 and 60% by volume; the proportion of the carrier medium is between 20 and 90% by volume, preferably between 30 and 80% by volume and the proportion of non-magnetisable additives is between 0.001 and 20% by mass, preferably between 0.01 and 15% by mass (relative to the magnetisable solids).

Figure 3:
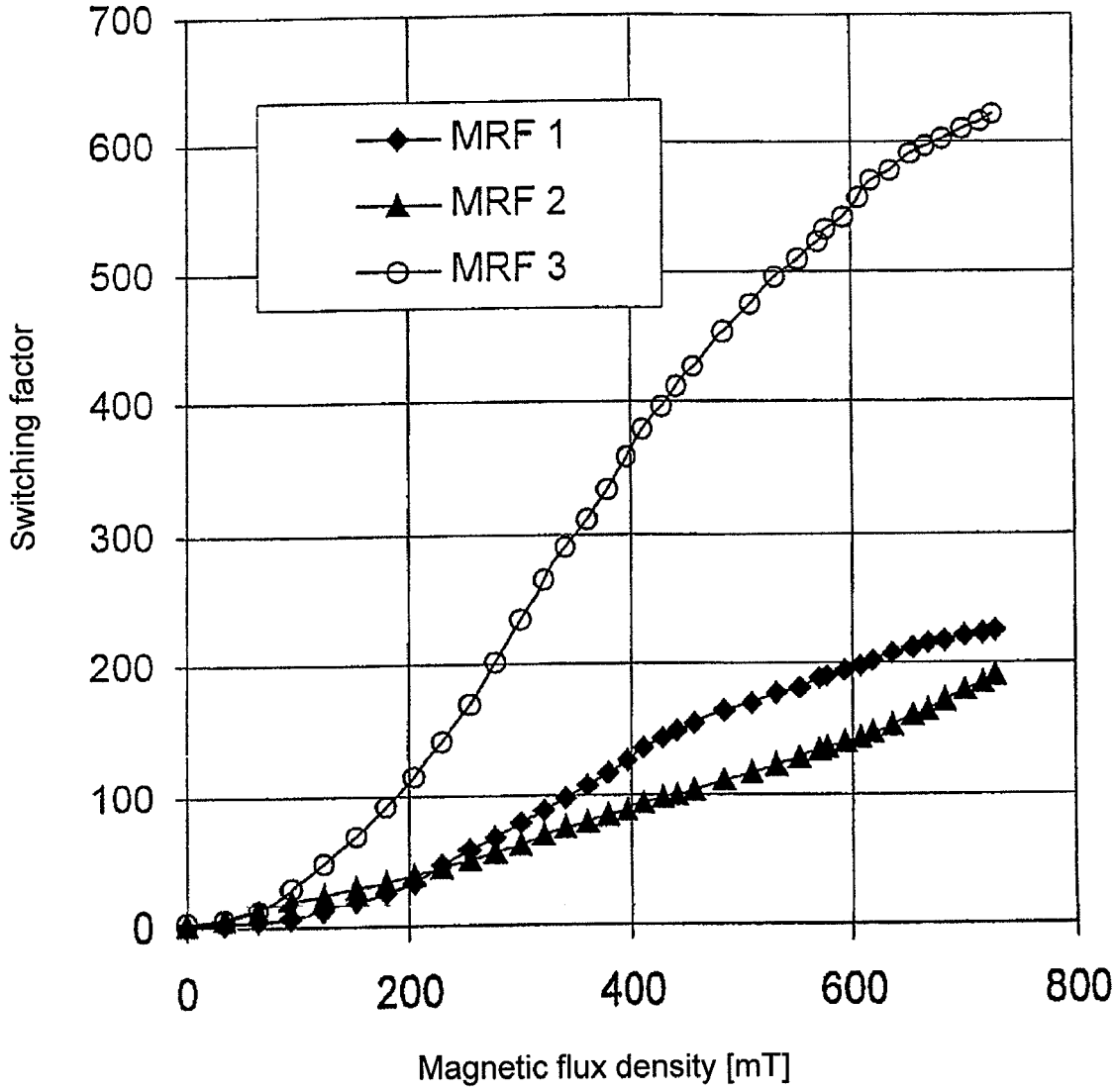

FIG. 3 shows the switching factor $W_D$ as a function of the magnetic flux density B for the MRF 3 (MRF with a particle mixture of small spherical particles and large irregularly shaped particles) according to the invention and for the two comparative batches MRF 1 (MRF with small spherical particles) and MRF 2 (MRF with large irregularly shaped particles) at a constant shear rate of D=100 $s^{-1}$.

The invention relates furthermore to the use of the materials described above in more detail.

An advantageous embodiment of the magnetorheological materials according to the invention provides use thereof in adaptive shock and vibration dampers, controllable brakes, clutches and also in sports or training appliances. Special materials can also be used for surface machining of workpieces.

Finally the magnetorheological materials can also be used to generate and/or to display haptic information, such as characters, computer-simulated objects, sensor signals or images, in haptic form, in order to simulate viscous, elastic and/or visco-elastic properties or the consistency distribution of an object, in particular for training and/or research purposes and/or for medical applications.

An example of the production of magnetorheological materials according to the invention, in particular the production of a magnetorheological fluid (MRF), is described in the following.

EXAMPLE 1

Educts used:

- polyalphaolefin with a density of 0.83 g/$cm^3$ at 15° C. and a kinematic viscosity of 48.5 mm/$s^2$ at 40° C.,
- irregularly shaped iron particles (p) with an average particle size of 41 μm, measured in isopropanol by means of laser diffraction with the help of a Mastersizer S by the company Malvern Instruments,
- spherical iron particles (q) with an average particle size of 4.7 μm, measured in isopropanol by means of laser diffraction with the help of a Mastersizer S by the company Malvern Instruments.

80 ml of a suspension with 35.00% by volume iron powder, thereof 23.33% by volume irregularly shaped particles (p) and 11.66% by volume spherical particles (q), are produced in polyalphaolefin as follows:

43.16 g polyalphaolefin are weighed out in a steel container of 250 ml volume to 0.001 g weighing accuracy. With constant agitation, firstly 146.96 g of the irregularly shaped iron powder (p) are then sprinkled in slowly, subsequently the addition of 73.45 g of the spherical iron particles (q) is effected in the same manner. The dispersion of the iron powder in the oil is effected with the help of a Dispermat by the company VMA-Getzmann GmbH by means of a dissolver disc with a diameter of 30 mm, a spacing existing between the dissolver disc and the container base of 1 mm. The treatment duration is 3 min. at approx. 6500 rpm. The agitation speed is adapted optimally to the viscosity of the batch when the rotating disc is visible clearly from the top while forming a spout.

The magnetorheological fluid MRF 3 produced in this way with the iron particle mixture (p)+(q) was subsequently characterised with respect to its properties and compared with two further correspondingly produced magnetorheological fluids. There was thereby contained

- MRF 1 instead of the particle mixture (p)+(q), 35% by volume of the pure spherical iron particles (q) in polyalphaolefin and
- MRF 2 instead of the particle mixture (p)+(q), 35% by volume of the pure irregularly shaped iron particles (p) in polyalphaolefin.

The rheological and magnetorheological measurements were effected in a rotational rheometer (Searle Systems) MCR 300 of the company Paar Physica. The rheological properties were thereby implemented without application of a magnetic field in a measuring system with coaxial cylindrical geometry, whereas the measurements in the magnetic field were effected in a plate-plate arrangement perpendicular to the field lines.

Figure 1:
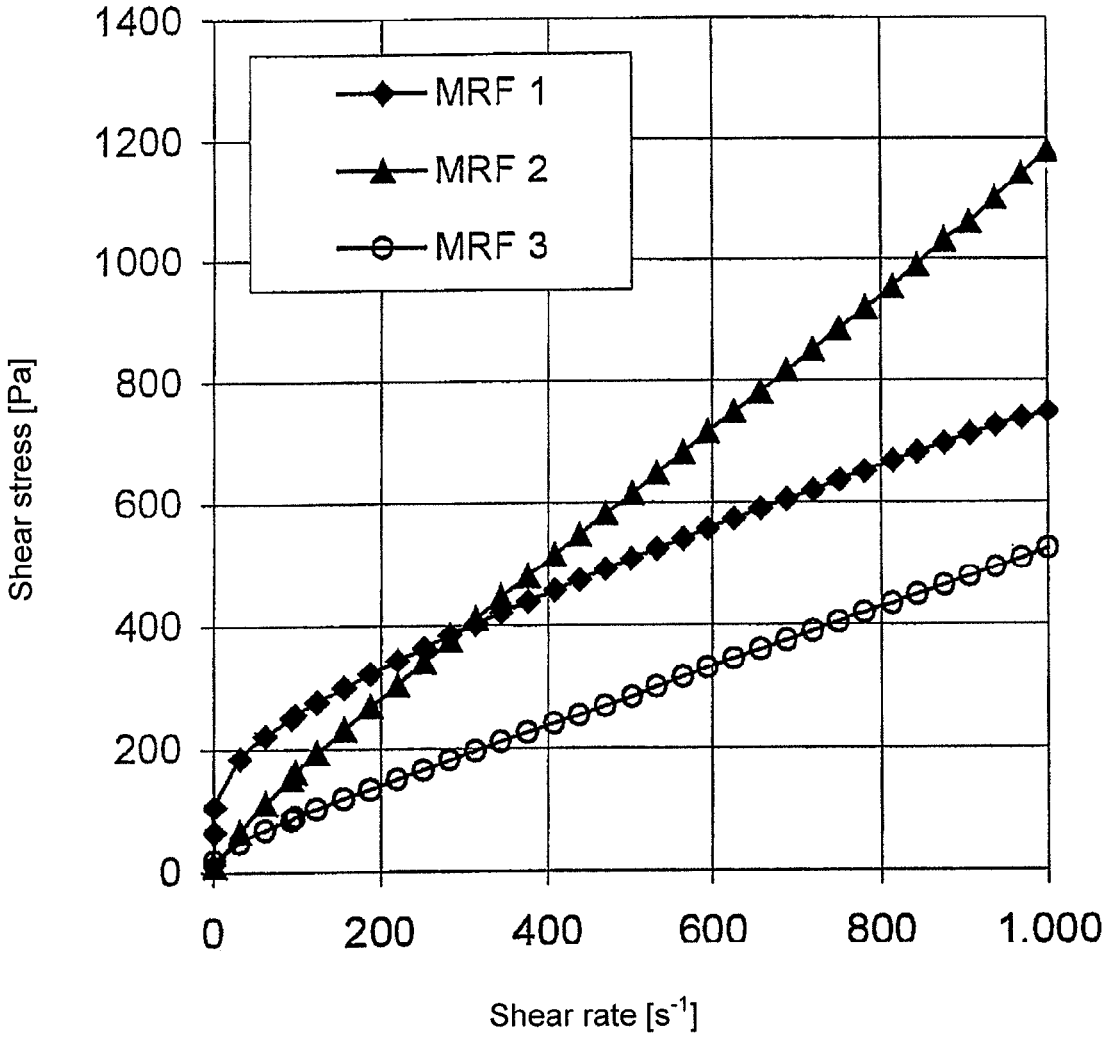
FIG. 1 shows the shear stress $\tau_O$ as a function of the shear rate D for the MRF 3 (MRF with a particle mixture of small spherical particles and large irregularly shaped particles) according to the invention and for the two comparative batches MRF 1 (MRF with small spherical particles) and MRF 2 (MRF with large irregularly shaped particles) without application of a magnetic field.
Figure 2:
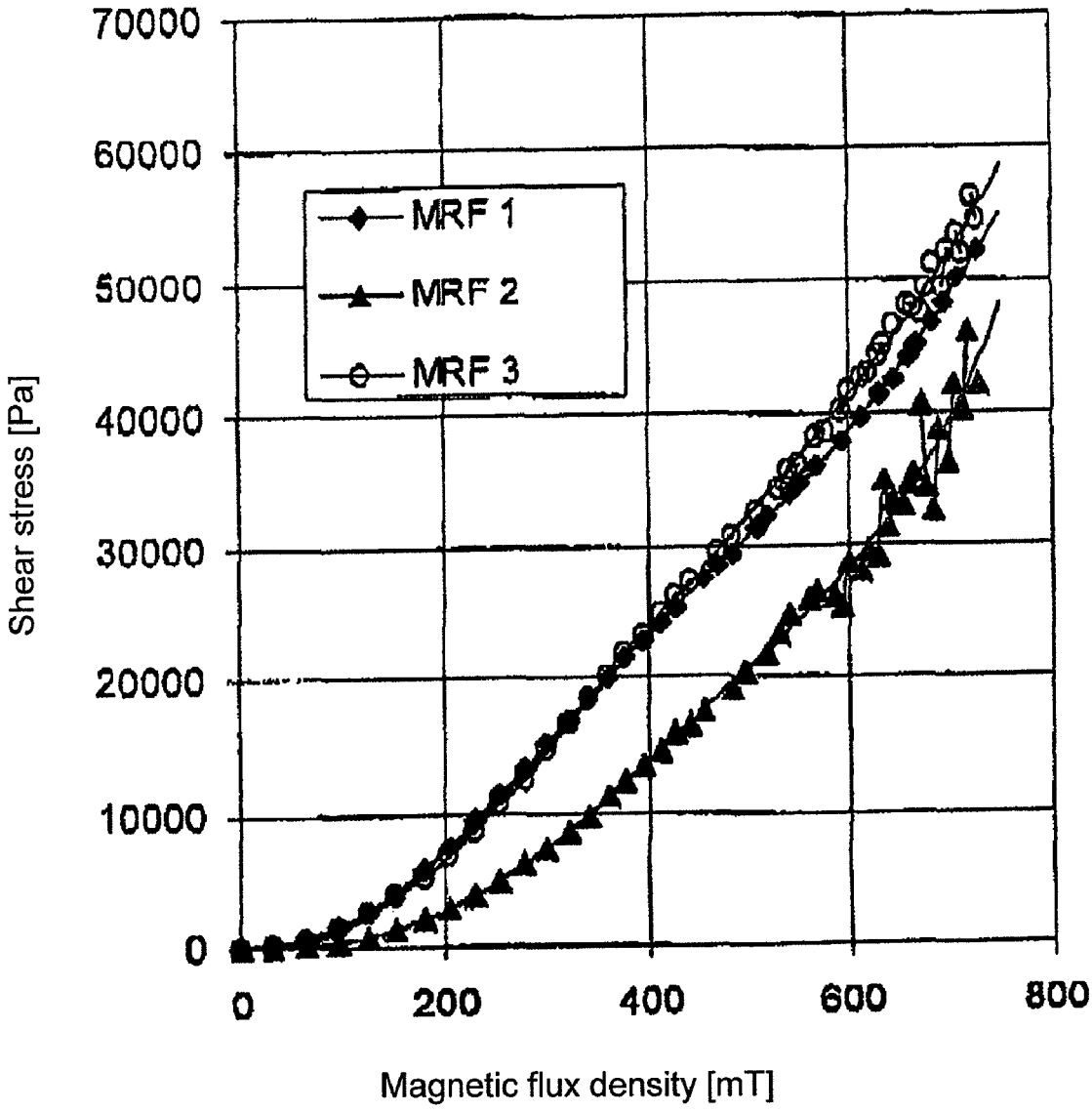
FIG. 2 shows the shear stress $\tau_B$ as a function of the magnetic flux density B for the MRF 3 (MRF with a particle mixture of small spherical particles and large irregularly shaped particles) according to the invention and also the two comparative batches MRF 1 (MRF with small spherical particles) and MRF 2 (MRF with large irregularly shaped particles) in the quasi static range (D=1 $s^{-1}$).

The results of this test are compiled in the FIGS. 1 to 3.

FIG. 1 shows the shear stress $\tau_O$ as a function of the shear rate D for the MRF 3 according to the invention and for the two comparative batches MRF 1 and MRF 2 without application of a magnetic field. It is detected that the flow curve of the MRF 3 according to the invention, at shear rates outwith the quasi static range (D>$1_s^{-1}$), is below that of MRF 1 and MRF 2. This means that the MRF 3 according to the invention, in the magnetic field-free space at a fixed shear rate D, has the smallest dynamic basic viscosity $\eta_O$ in comparison with the remaining batches (cf. equation (1) of the description).

FIG. 2 shows the shear stress $\tau_B$ as a function of the magnetic flux density B for the MRF 3 according to the invention and also the two comparative batches MRF 1 and MRF 2 in the quasi static range (D=1 $s^{-1}$). It is detected that the MRF 3 according to the invention has higher shear stresses $\tau_B$ in the entire measuring range than the comparative batch MRF 2 which contains merely irregularly shaped iron particles (p). It is detected furthermore that the shear stress $\tau_B$ of the MRF 3 according to the invention extends up to a shear rate of D=400 $s^{-1}$ congruently with that of MRF 1 but then also exceeds the values thereof. This means that the MRF 3 according to the invention has the same or higher shear stresses $\tau_B$ in the magnetic field as MRF 1 which contains merely small spherical iron particles (q).

In summary it can hence be stated that the MRF 3 according to the invention has in total the highest shear stresses $\tau_B$ in the magnetic field in comparison with the batches MRF 1 and MRF 2 without particle mixtures.

FIG. 3 shows the switching factor $W_D$ as a function of the magnetic flux density B for the MRF 3 according to the invention and for the two comparative batches MRF 1 and MRF 2 at a constant shear rate of D=100 $s^{-1}$. It is detected that the switch factor $W_D$ of the MRF 3 according to the invention exceeds those of the batches MRF 1 and MRF 2 in the entire measuring range. Hence for example with a flux density of B=500 mT, an increase in the switching factor $W_D$ by the factor 3 in relation to MRF 1 or by the factor 5 in relation to MRF 2 can be determined.

It remains to be stressed in total that the MRF 3 according to the invention with the particle mixture comprising large irregularly shaped iron particles and small spherical iron particles has both the lowest dynamic basic viscosity $\eta_o$ in the field-free space and the greatest switching factor $W_D$ in the magnetic field in relation to the comparative batches MRF 1 and MRF 2.

The invention claimed is:

1. A magnetorheological material comprising at least one non-magnetisable carrier medium and magnetisable particles consisting of soft magnetic particles contained therein, wherein at least two magnetisable particle fractions p and q are contained as particles, p being formed from non-spherical particles and q from spherical particles, wherein the average particle size of p is equal or greater than q, and further comprising particulate additives selected from graphite, perfluoroethylene, molybdenum compounds and combinations thereof.

2. A magnetorheological material according to claim 1, wherein the average particle size of the fraction p has at least twice the value of the average particle size of the fraction q.

3. A magnetorheological material according to claim 1, wherein the average particle sizes of the fractions p and q are between 0.01 μm and 1000 μm.

4. A magnetorheological material according to claim 1, wherein the volume ratio of the fractions p and q is between 1:99 and 99:1.

5. A magnetorheological material according to claim 1, wherein the magnetisable particles are soft magnetic metallic materials.

6. A magnetorheological material according to claim 5, wherein the soft magnetic metallic materials are selected from iron, cobalt, nickel, alloys thereof, magnetic steel, iron-silicon, and a mixture thereof.

7. A magnetorheological material according to claim 1, wherein the magnetisable particles are soft magnetic oxide-ceramic materials.

8. A magnetorheological material according to claim 7, wherein the soft magnetic oxide-ceramic material is selected from cubic ferrites, perovskites, garnets, and mixtures thereof.

9. A magnetorheological material according to claim 8, wherein the cubic ferrite is of the general formula $$MO.Fe_2O_3$$

with one or more metals from the group M=Mn, Fe, Co, Ni, Cu, Zn, Ti, Cd or Mg.

10. A magnetorheological material according to claim 8, wherein the perovskite is of the general formula $$M^{3+}B^{3+}O_3$$

where M is a trivalent rare earth element and B is Fe or Mn, or $$A^{2+}Mn^{4+}O_3,$$

where A is Ca, Sr, Pb, Cd, or Ba.

11. A magnetorheological material according to claim 8, wherein the garnet is of the general formula $$M_3B_5O_{12}$$

where M is a rare earth element and B is iron or iron doped with Al, Ga, Sc, or Cr .

12. A magnetorheological material according to claim 1, wherein the magnetisable particles are mixed ferrites.

13. A magnetorheological material according to claim 12, wherein the mixed ferrite is selected from MnZn-, NiZn-, NiCo-, NiCuCo-, NiMg-, CuMg- ferrites and mixtures thereof.

14. A magnetorheological material according to claim 1, wherein the magnetisable particles are selected from iron carbide or iron nitride and also alloys of vanadium, tungsten, copper and manganese and mixtures thereof.

15. A magnetorheological material according to claim 1, wherein the magnetisable particles are present in pure form, impure form, or a combination thereof.

16. A magnetorheological material according to claim 1, wherein the carrier medium is a carrier fluid selected from water, mineral oils, synthetic oils, polyalphaolefins, hydrocarbons, silicone oils, esters, polyethers, fluorinated polyethers, polyglycols, fluorinated hydrocarbons, halogenated hydrocarbons, fluorinated silicones, organically modified silicones, copolymers thereof, and fluid mixtures thereof, a fat or gel or an elastomer.

17. A magnetorheological material according to claim 1, further containing additives selected from dispersion agents, antioxidants, defoamers and anti-abrasion agents.

18. A magnetorheological material according to claim 1, further containing additives selected from inorganic particles, organic additives, and combinations thereof.

19. A magnetorheological material according to claim 18, wherein the inorganic particles are at least in part organically modified.

20. A magnetorheological material according to claim 1, further containing abrasively acting and/or chemically etching supplements.

21. A magnetorheological material according to claim 20, wherein the abrasively acting and/or chemically etching supplements are selected from corundum, cerium oxides, silicon carbide and diamond.

22. A magnetorheological material according to claim 1, further comprising additives, wherein the magnetisable particles are present in an amount between 10 and 70% by volume;

the carrier medium is present in an amount between 20 and 90% by volume, and the additives are present in an amount between 0.001 and 20% by mass (relative to the magnetisable solids).

23. A magnetorheological material according to claim 1, further comprising additives, wherein the magnetisable particles are present in an amount between 20 and 60% by volume;

the carrier medium is present in an amount between 30 and 80% by volume; and the additives are present in an amount between 0.01 and 15% by mass (relative to the magnetisable solids).

the magnetisable particles are present in an amount between 10 and 70% by volume, the the carrier medium is present in an amount between 20 and 90% by volume, and the additives are present in an amount between 0.01 and 20% by mass (relative to the magnetisable solids).

* * * * *